US005765357A

United States Patent [19]

Burgess et al.

[11] Patent Number: 5,765,357

[45] Date of Patent: Jun. 16, 1998

[54] METHOD FOR PRODUCING A COMPACTED WIRE STRAND SUBSTANTIALLY TRIANGULAR IN SHAPE FOR MAKING WIRE ROPE

[75] Inventors: Walter Burgess, Blainville; Robert H. Bole, Pierrefonds; Jean Addison, St-Remi D'Amherst, all of Canada

[73] Assignee: Wire Rope Industries Limited, Canada

[21] Appl. No.: 780,684

[22] Filed: Jan. 8, 1997

Related U.S. Application Data

[62] Division of Ser. No. 584,138, Jan. 11, 1996.

[51] Int. Cl.[6] ..... D01H 13/26; D02G 3/36

[52] U.S. Cl. ..... 57/311; 57/9; 57/12; 57/13

[58] Field of Search ..... 57/200, 210, 211, 57/212, 213, 214, 215, 216, 218, 219, 222, 237, 311, 3, 9, 12, 13

[56] References Cited

U.S. PATENT DOCUMENTS

| | | | |
|---|---|---|---|
| 1,393,750 | 10/1921 | Carter | 57/211 |
| 2,098,922 | 11/1937 | McKnight | 57/9 |
| 2,620,818 | 12/1952 | Chamoux | 57/215 |
| 3,035,403 | 5/1962 | Grimes et al. | 57/215 |
| 3,675,409 | 7/1972 | Rosenstein | 57/13 |
| 4,244,172 | 1/1981 | Glushko et al. | 57/215 |
| 4,270,341 | 6/1981 | Glushko et al. | 57/215 |
| 5,260,516 | 11/1993 | Blackmore | 57/9 |
| 5,323,595 | 6/1994 | Mizuta et al. | 57/212 |

FOREIGN PATENT DOCUMENTS

| | | | |
|---|---|---|---|
| 582258 | 7/1933 | Germany . | |
| 3723720 | 2/1988 | Germany | 57/211 |
| 490890 | 3/1976 | U.S.S.R. | 57/9 |
| 794411 | 5/1958 | United Kingdom . | |

*Primary Examiner*—William Stryjewski

*Attorney, Agent, or Firm*—Fitzpatrick, Cella, Harper & Scinto

[57] ABSTRACT

A method for producing a compacted wire strand substantially triangular in shape for making wire rope includes the steps of (i) unwinding a central group of wires from a bobbin, the central group being substantially triangular, (ii) winding up a first layer of wires around the central group, each wire of the first layer being released from a first set of bobbins mounted on a first cage rotating about the central group, (iii) winding up a second layer of wires around the first layer of wires, each wire of the second layer being released from a second set of bobbins mounted on a second cage rotating around the central group, the first cage rotating at a speed 1.6 to 1.9 times faster than that of the second cage, (iv) compacting the strand made of the first and second layers of wires in a substantially triangular die by pulling the strand therethrough, and (v) rolling up the compacted substantially triangular strand on a drum.

12 Claims, 4 Drawing Sheets

Solid Triangle

Brangle

3 & 3

3 X 2
and Filers

METHOD FOR PRODUCING A COMPACTED WIRE STRAND SUBSTANTIALLY TRIANGULAR IN SHAPE FOR MAKING WIRE ROPE

This application is a division of application Ser. No. 08/584.138, filed Jan. 11, 1996, now pending.

FIELD OF THE INVENTION

The present invention is concerned with a compacted substantially triangular strand suitable for making wire ropes, and method for obtaining the same.

BACKGROUND OF THE INVENTION

The manufacturing of compacted strands has become a standard practice over the years in the wire rope making industries. Such process consists in compacting a round strand by pulling it through a die having a diameter smaller than that of the strand. By doing so, the external wires and some inner wires of the strand are plastically deformed, and the final diameter of the strand is reduced. This procedure causes the wire ropes made of such strands to have an increased metallic area when compared to wire ropes made of noncompacted strands. Further, it subjects the external wires to an additional cold deformation. Both effects significantly increase the strength of wire ropes made of such compacted strands. Up to now, because of the limitations inherent to the current methods, only compacted round strands are produced.

Substantially triangular strands, commonly referred to in art as "flattened strands," have also been proposed to further improve the strength of wire ropes. Six substantially triangular strands wound around a core to form a round wire rope provide up to about 10% more metallic area when compared to a wire rope of the same diameter made of round strands. Wire ropes made of such strands are also highly resistant to crushing and abrasion due to increased exposed surface compared to a standard wire rope made of round strands.

Research remains active to find wire ropes with even more superior strength and resistance properties which can be produced at reasonable costs.

SUMMARY OF THE INVENTION

In accordance with the present invention, there is provided a method for producing a compacted substantially triangular strand suitable for making wire ropes, the method comprising unwinding a central group of wires from a bobbin, the central group being substantially triangular; winding up a first layer of wires around the central group, the wires being released from a first set of bobbins mounted on a first cage rotating around the central group; winding up a second layer of wires, the wires being released from a second set of bobbins mounted on a second cage rotating around the central group, the first cage rotating at a speed 1.6 to 1.9 times faster than that of the second cage; compacting the thus obtained strand in a substantially triangular die by pulling the strand therethrough; and rolling up the compacted substantially triangular strand on a drum.

The strand and wire rope obtained therefrom are also part of the present invention. Preferably, the strand has a first layer of from 7 to 12 wires wound around the center group, and a second layer of from 10 to 15 wires wound around the first layer.

IN THE DRAWINGS

FIGS. 5(*a*)–5(*d*) illustrate examples of conventional triangular center groups suitable for the strands of the present invention.

DETAILED DESCRIPTION OF THE INVENTION

In order to benefit from the strand compaction technology and the use of substantially triangular strands, a new method for the compaction of substantially triangular strands has been developed. This novel method produced a novel generation of wire ropes, which are also part of the present invention.

Production of Substantially Triangular Strands

Figure 1B:
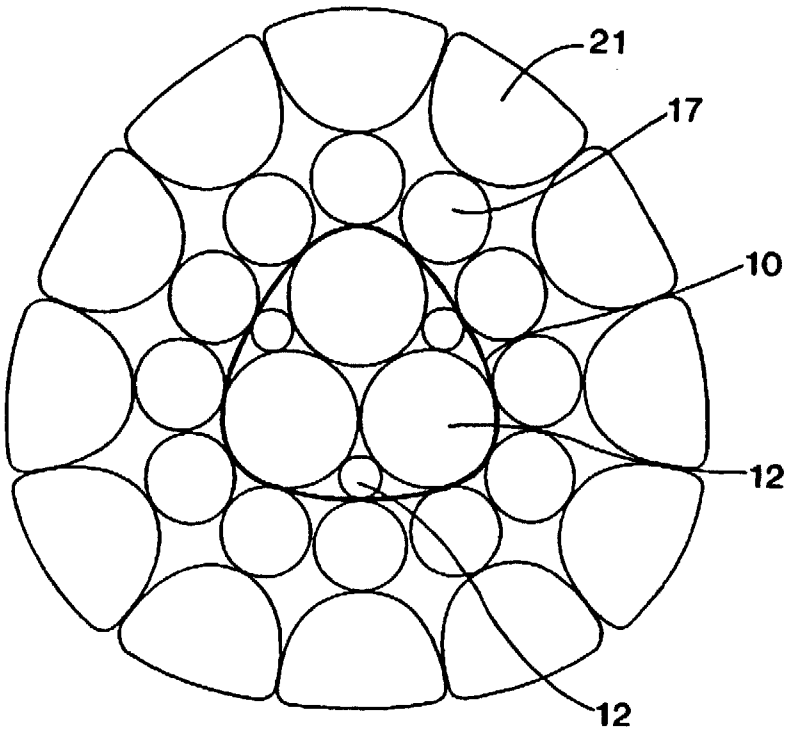
FIGS. 1A and 1B illustrate sectional views of noncompacted and compacted substantially triangular strands, respectively.

As illustrated in FIG. 1B, each strand is obtained from a central group 10 of wires 12 disposed in a substantially triangular form. Such a central groups of wires can be obtained by any conventional method for producing substantially triangular strands, and therefore have the same conventional configuration (see FIGS. 5(*a*)–5(*d*). The strand is then completed by adding one or two more layers of wires around the central group. The strands thus formed are then compacted with a substantially triangular die designed for that matter. The die, as well as the method for obtaining the compacted substantially triangular strand, will be further discussed hereinbelow.

Figure 1A:
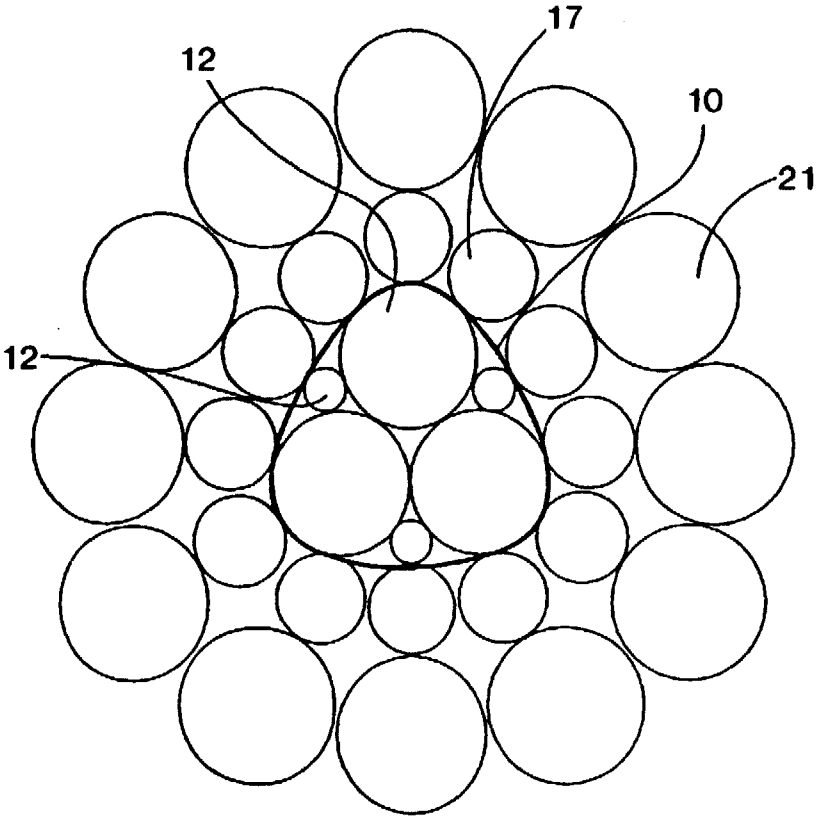

The organization of the wires on the primary and secondary layers is similar to that of noncompacted substantially triangular strands as illustrated in FIG. 1, with the proviso that the choice of the wires and their location is such that the total surface of the strand before compaction is at least 8% higher than the nominal value of the strand after compaction. A sectional view of a substantially triangular strand before and after compaction is illustrated in FIGS. 1A and 1B respectively.

Various possible organizations of compacted substantially triangular strands are illustrated in Table 1. The dimensions of the strands depend on the diameter of the wires used and their arrangement in the strand. The dimension of the strand is also dependent on the size of the compaction die. Generally, the altitude of the die is fixed at about 1% smaller than the nominal altitude of the strand after compaction to compensate for the elastic return.

TABLE 1

Combinations of filaments for primary and secondary layers

| Central Group (according to FIG. 5) | number of filaments on the first layer | number of filaments on the second layer |
|---|---|---|
| 1, 2, 3, 4 | 7 | — |
| 1, 2, 3, 4 | 8 | — |
| 1, 2, 3, 4 | 9 | — |
| 1, 2, 3, 4 | 12 | 10 |
| 1, 2, 3, 4 | 12 | 11 |
| 1, 2, 3, 4 | 12 | 12 |
| 1, 2, 3, 4 | 12 | 13 |
| 1. 2, 3, 4 | 12 | 14 |
| 1, 2, 3, 4 | 12 | 15 |

Various lay lengths may be induced in the strand depending on the desired properties of the wire rope. The critical step in the stranding method is the correct indexation of the substantially triangular strand with the rotating die, which is also substantially triangular. Such indexation is not required for round compacted strands.

Because of the triangular geometry of the strand, six strands are always required to make a wire rope. A wide range of wire ropes made of compacted substantially triangular strands can be produced, the diameter being related to the altitude of the triangular strands used.

The core of the wire rope may be of any material conventionally in use, for example natural fibres like Sisal, synthetic fibres like nylon, polyester, polypropylene, solid plastic core and the like, steel, steel covered with plastic etc.

Figure 2:
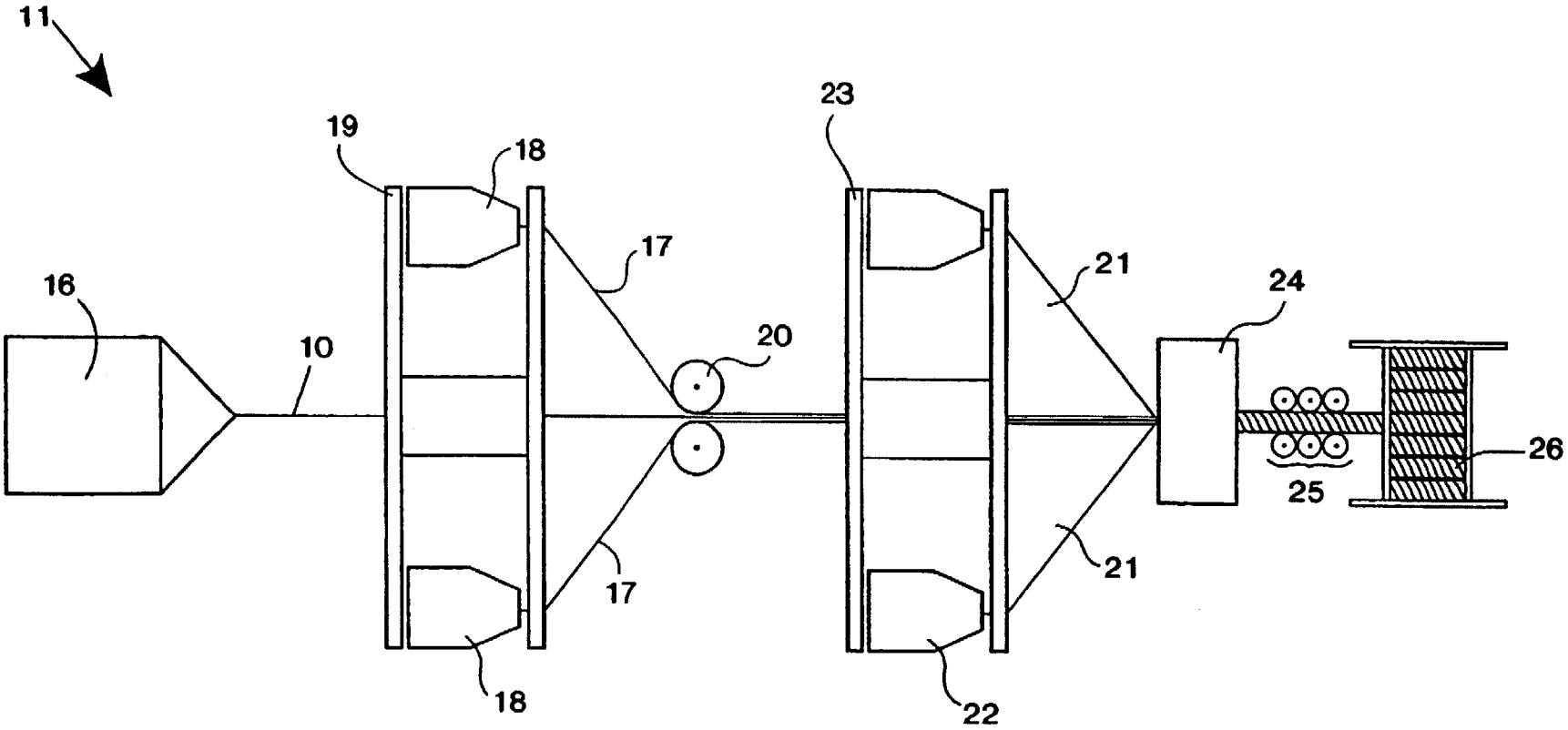
FIG. 2 illustrates a preferred system used to perform the method of the present invention.

The production of a substantially triangular strand is carried out in a specially designed system 11, as illustrated in FIG. 2. As it can be seen, substantially triangular center group 10 is released from a first rotating bobbin 16. Although not illustrated in FIG. 2, it is also possible to add a section of cage and bobbins in front of bobbin 16 to manufacture center group 10 concurrently with the strand. Subsequently, from 7 to 12 wires 17, previously referred to as the first layer, are wound up around center group 10.

Figure 3:
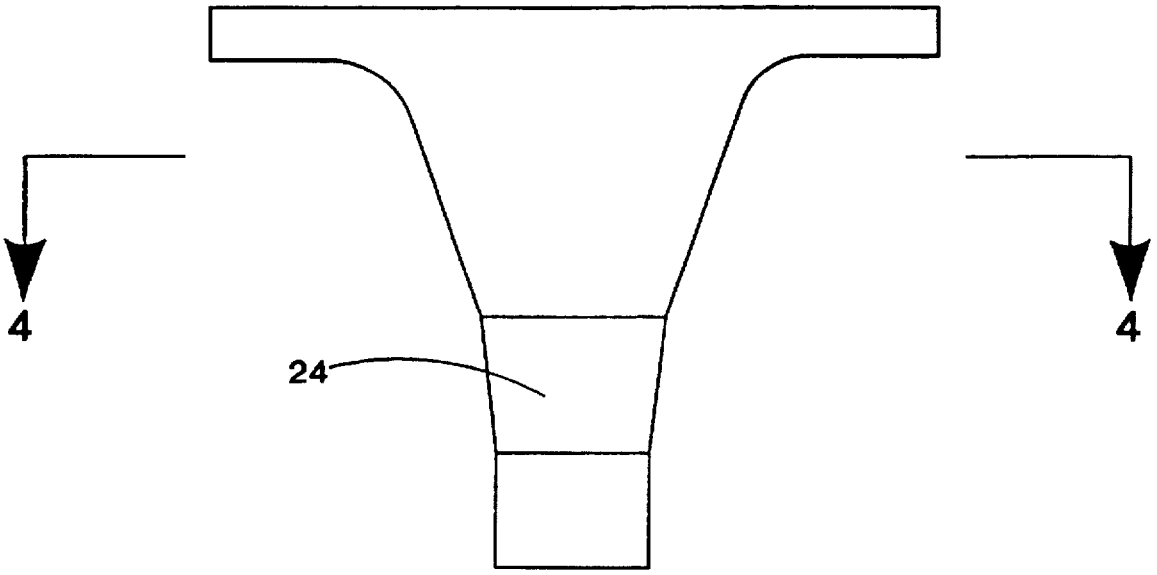
FIG. 3 illustrates a side view of the substantially triangular die.
Figure 4:
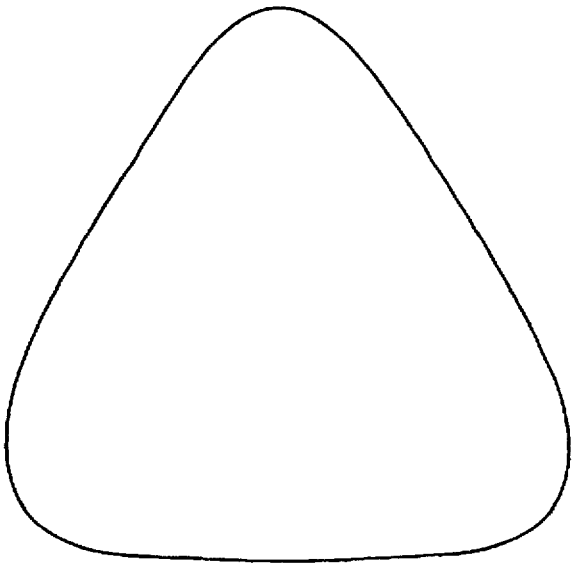
FIG. 4 is a view along line 4–4 of FIG. 3.
Figure 5A:
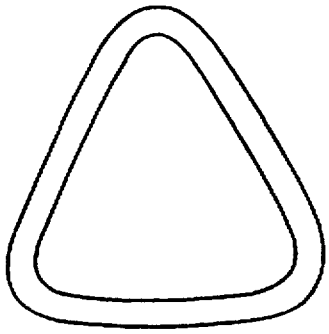
Figure 5B:
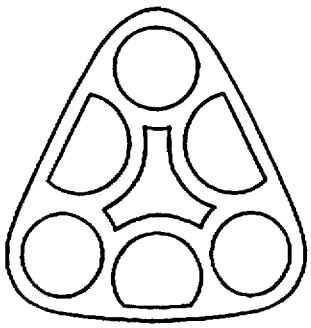
Figure 5C:
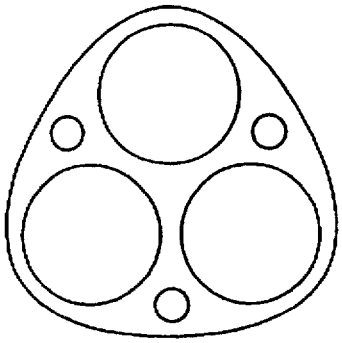
Figure 5D:
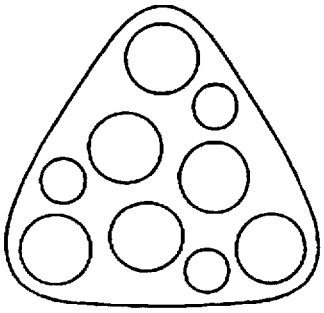

The wires are contained in a plurality of bobbins 18 mounted on a rotating cage 19. The strand is then compacted with a first set of rolls 20 having a substantially triangular inner section before winding up a second layer of from 10 to 15 wires 21 also contained in a plurality of bobbins 22 from second cage 23. The strand is then compacted through the rotating substantially triangular die 24 (FIGS. 3 & 4). Finally, the compacted substantially triangular strand passes through a series of post forming rolls 25 to relieve the residual stress and stabilize the strand, before being collected, by rotating drum 26.

The critical issue in the method is the relative speed of rotation of each cage of bobbins during the production of the strand. Many major problems were encountered with conventional relative speeds used for noncompacted substantially triangular strands. The most important problem was the formation of a so-called "bird cage"just before passing the strand through die 24. During the stranding process, the wires of the outer layer stuck and accumulated in front of the die. This problem is very well known in the field and causes costly wastes of time and material. After many attempts, this problem was overcome by setting the rotating speed of cage 19 from 1.6 to 1.9 times faster than that of cage 23. The rotating speed of bobbin 16 must be the same as that of rolls 20 and die 24. Rolls 25 are fixed.

Closing of a wire rope containing 6 strands as produced above can be carried out in any conventional device used for making wire ropes made of conventional noncompacted substantially triangular strands.

While the invention has been described in connection with specific embodiments thereof, it will be understood that it is capable of further modifications and this application is intended to cover any variations, uses or adaptations of the invention following, in general, the principles of the invention and including such departures from the present disclosure as come within known or customary practice within the art to which the invention pertains, and as may be applied to the essential features hereinbefore set forth, and as follows in the scope of the appended claims.

What is claimed is:

1. A method for producing a compacted substantially triangular strand suitable for making wire ropes, the method comprising the steps of:

unwinding a central group of wires from a bobbin, the central group being substantially triangular;

winding up a first layer of wires around the central group, each wire of the first layer being released from a first set of bobbins mounted on a first cage rotating around the central group;

winding up a second layer of wires around the first layer of wires, each wire of the second layer being released from a second set of bobbins mounted on a second cage rotating around the central group, the first cage rotating at a speed 1.6 to 1.9 times faster than that of the second cage;

compacting the strand comprising the first and second layers of wires in a substantially triangular die by pulling said strand therethrough; and rolling up the compacted substantially triangular strand on a drum.

2. A method according to claim 1 wherein the number of bobbins on the first cage is from 7 to 12.

3. A method according to claim 1 wherein the number of bobbins on the second cage is from 10 to 15.

4. A compacted substantially triangular strand suitable for making wire rope and produced in according to the method of claim 1.

5. A triangular strand according to claim 4, wherein the number of wires in the first layer is from 7 to 12, and the number of wires in the second layer is from 10 to 15.

6. A wire rope according to claim 4, wherein the number of strands is 6.

7. A method according to claim 1, wherein the die is rotating.

8. A method according to claim 7 wherein the die is rotating at the same speed as that of the bobbin of the central group.

9. A wire rope comprising a plurality of strands produced according to the method of claim 7.

10. A wire rope according to claim 9, wherein the center of the wire rope is made from a material selected from the group consisting of natural fibers, synthetic fibers, steel, and steel covered with plastic.

11. A wire rope comprising a plurality of strands produced according to the method of claim 1.

12. A wire rope according to claim 11, wherein the center of the wire rope is made of a material selected from the group consisting of natural fibers, synthetic fibers, steel, and steel covered with plastic.

* * * * *